United States Patent [19]

Davis et al.

[11] 4,041,815

[45] Aug. 16, 1977

[54] METHOD FOR PERFORATING ROOFING SHEET MATERIAL

[75] Inventors: Duane A. Davis, Plainfield; Michael P. Krenick, Somerville, both of N.J.

[73] Assignee: GAF Corporation, New York, N.Y.

[21] Appl. No.: 680,887

[22] Filed: Apr. 27, 1976

Related U.S. Application Data

[62] Division of Ser. No. 566,765, April 10, 1975, Pat. No. 3,983,773.

[51] Int. Cl.[2] ..... B26F 1/24

[52] U.S. Cl. ..... 83/30; 156/253

[58] Field of Search ..... 83/30, 54, 660, 188, 83/190, 192, 193; 156/253; 206/389; 53/118; 242/56.8

[56] References Cited

U.S. PATENT DOCUMENTS

| | | | |
|---|---|---|---|
| 1,398,320 | 11/1921 | Dunsworth | 83/192 X |
| 1,456,344 | 5/1923 | Van Ness | 83/660 X |
| 2,339,773 | 1/1944 | Egan | 83/30 X |
| 2,550,937 | 5/1951 | Pye | 29/566 |

*Primary Examiner*—Travis S. McGehee

*Attorney, Agent, or Firm*—Walter C. Kehm; Arthur Dresner

[57] ABSTRACT

The apparatus of the present invention comprises at least one hole-punching device operated by a pneumatic cylinder for driving a punch rod through the peripheral surface and radially to the center of a roll of roofing sheet material. The method of the invention provides for the steps of preparing the sheet roofing material, winding the sheet into a roll, and punching a plurality of perforation holes in the roll from the surface to the center thereof.

5 Claims, 5 Drawing Figures

METHOD FOR PERFORATING ROOFING SHEET MATERIAL

This is a division of application Ser. No. 566,765, filed Apr. 10, 1975 now U.S. Pat. No. 3,983,773.

BACKGROUND OF THE INVENTION

The present invention relates generally to the field of manufacture and preparation of roofing sheet material, generally of the asphalt type, and more specifically to a method and apparatus for forming a plurality of holes in the roofing material.

Sheet roofing material is usually prepared by treating a web of roofing felt with asphalt so as to saturate the felt. It is presently desirable to provide the treated web of sheet roofing material with a number of holes or apertures to provide means of escape for air or vapor so that such air or vapor will not be trapped under the roofing material during installation on a roof. A variety of prior art devices and techniques have been employed for the purpose of providing the desired holes or apertures.

One such prior art technique for perforating the web of sheet roofing material involves the use of a needle roll or cylinder and an opposed grooved-in wire brush roll so that the web of sheet material may be passed therebetween and needles carried on the needle roll will penetrate the roofing material so as to form the perforations. The insertion of the needles into the sheet material, however, only causes a separation of the roofing material with little or no removal of the material by the needles. Consequently, the holes formed by the insertion of the needles will have a tendency to close up as a result of forces applied to the sheet material during further treating or manufacturing processes, to be performed on the web, such as further rolling or winding the web into rolls. As a result, this method has been found to be unsatisfactory since air or vapor may yet be trapped under the roofing material during installation on a roof.

A further prior art technique is to utilize a cutting knife mounted on a cutting roll including a surface with a leading end cutting edge and a trailing end cutting edge so that sections of the web of sheet material will be cut-out by the knife element thus removing a certain amount of sheet material from the web. This technique is an improvement over the needle roll technique since the cut-out areas will not completely close up during the winding of the material into rolls because of compressive forces applied thereto. This technique, however, has the further disadvantages of producing waste and requiring complicated and expensive cutting machinery to be employed in the treating or manufacturing process.

The prior art techniques have the further disadvantage of being used during the in-line treating or manufacturing of the sheet material, prior to winding or rolling so that the speed of the manufacturing operation may be hindered or affected by the cutting or needle insertion operation. Further, the prior art techniques require that the devices used to perforate the sheet material be an integral part of the manufacturing process and be performed while the roofing material is in web form so that it can only be done at a particular stage in the treating or manufacturing operation.

It is accordingly one object of the present invention to provide a technique of perforating sheet roofing material which overcomes the disadvantages of the prior art.

It is a further object of the present invention to provide an apparatus and method for forming a plurality of permanent and distinct perforation holes in roofing or other sheet material by punching said holes into the sheet material after the completion of the normal manufacturing process and after the sheet material has been formed into wound rolls for storage or shipment to the place of ultimate use.

Another object of the present invention is to provide an apparatus that is durable, easy-to-use, easy-to-maintain, relatively inexpensive, portable, and separate and distinct from the equipment or in-line operation used in the treating or manufacturing process.

A further more specific object of the present invention is to provide an apparatus for perforating rolls of roofing sheet material by supporting the roll on a spindle of a turret, and moving that spindle into a perforating station where a plurality of hole-punching devices will be actuated to penetrate the roll from at least two different directions.

A further object of the present invention is to provide a method and means for perforating rolled sheet material at any time and any place rather than being restricted to times and places of manufacturing.

The above objects, features and advantages, along with other objects, features and advantages, of the present invention will become more apparent from the detailed description of the invention in conjunction with the accompanying drawings to be described more fully hereinafter.

SUMMARY OF THE INVENTION

The foregoing objects are generally accomplished by providing a means for forming (punching) perforation holes in roofing sheet material or other sheet material after the material has been formed into rolls and subsequent to any treating or other manufacturing operation performed on the sheet material, so that the hole punching operation is independent of such treating or manufacturing process and may be performed at any time or place remote from such treating or manufacturing operation. As a result, the perforation holes formed in the sheet material after the sheet is wound into rolls, will not have a tendency to close-up since the sheet material will not be subject to further compressive or other forces as further treating or manufacturing and winding processes have been complete.

Specifically, the method of the invention for forming perforation holes in sheet material comprises the steps of winding said sheet material into a roll, transporting said roll to a hole punching station, driving a punch rod radially through said rolled sheet material, and withdrawing said punch rod therefrom, thereby forming a plurality of holes simultaneously in the wound layers of said sheet material.

Additionally, the apparatus of the present invention for forming perforation holes in roofing sheet material comprises means for supporting thereon a roll of roofing sheet material, means for securely positioning said roll on said support means positioned with respect to said roll for forming a plurality of holes in successive layers of the wound sheet material, means for actuating said means for forming said holes into said wound roll, and means for withdrawing said hole forming means therefrom thereby forming a plurality of perforation holes therein.

The provision of a pneumatically operated punch as provided by the present invention eliminates the need for in-line devices to form perforation holes in the web of sheet material and may further be used at any time or place. Since the holes are formed in the sheet material after it has been wound into a roll, there is no likelihood of the holes closing up as no further forces will be applied to the sheet material.

The apparatus of the present invention may also be provided with a turret having a plurality of spindles radially extending therefrom for receiving the rolls of sheet material and for moving those rolls into a hole-punching position. Such an apparatus will further be provided with means for locking one of the spindles when moved to the hole-punching position and provided with a movable frame with a plate for engaging the roll carried on the spindle for securely positioning the roll to receive a plurality of punch rods actuated by pneumatic cylinders carried by the movable frame.

Provision is made for indexing the turret after each successive hole-punching operation so that the roll which has been punched can be moved to a removal station and so that a roll carried on a previous spindle can be moved into hole-punching position.

The foregoing and other features of the method and apparatus for forming perforated holes in sheet roofing material are more fully described with reference to the annexed drawings.

BRIEF DESCRIPTION OF THE DRAWINGS

There follows a detailed description of preferred embodiments of the invention to be read together with the accompanying drawings wherein.

DESCRIPTION OF THE INVENTION

Figure 1:
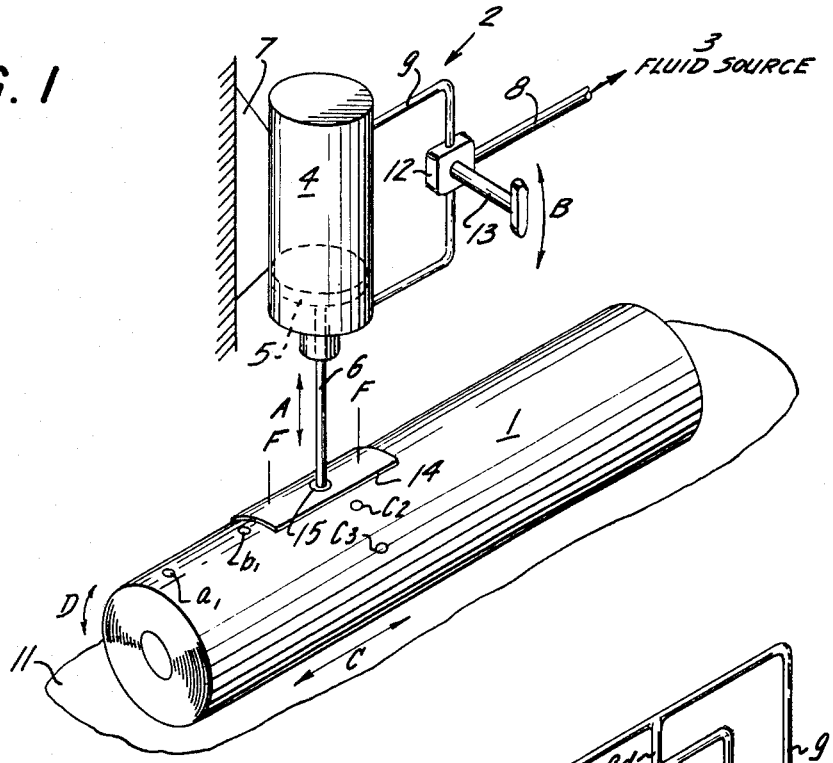
FIG. 1 is a perspective view showing one embodiment of the present invention arranged for forming perforation holes in a roll of sheet material.

Referring now in more detail to the accompanying drawings, the basic elements and principals of the present invention can be understood from FIG. 1 which shows in perspective and somewhat schematic from an arrangement of the apparatus of the present invention in a simple embodiment for punching perforation holes in a roll of sheet material.

In the embodiment of FIG. 1, a roll of roofing or other sheet material 1 is positioned on a support or platform 11 with respect to the hole punching apparatus designated generally as 2. The apparatus comprises a pneumatic cylinder 4 which may be carried on a frame 7 for support above the platform 11. A punch rod 6 is carried by the cylinder for movement toward or away from the roll as indicated by double headed arrow A. The punch rod 6 may be connected to a piston 5 carried within the cylinder 4 in a typical manner. A source of pressurized fluid 3 is connected to a main conduit 8 to provide the necessary actuating pressure to the pneumatic cylinder 4. A valve 12 is positioned so that when a selection lever 13 is in a first position pressurized fluid will flow from conduit 8 into conduit branch 9 and to vent conduit branch 10 to the atmosphere so as to provide actuating pressure to the cylinder forcing the piston and connected punch rod 6 in a downward direction so that punch rod 6 will be inserted into the roll of sheet material 1 positioned thereunder. Lever 13 then may be manually moved to the opposite position of valve 12 so that the pressurized fluid will enter conduit 10 providing actuating pressure to the other side of the piston within the cylinder 4 so as to drive the piston and connected punch rod 6 in an upward direction thus retracting the punch rod from the roll of sheet material. The valve 12 is self-bleeding so that the unpressurized end of the cylinder will be at atmospheric pressure when the valve is in a position for pressurizing the other end of the cylinder. Depending upon the positioning of the support table 11 and the cylinder 4 with respect thereto, the punch rod 6 will be allowed to be inserted to any desired depth of the roll of sheet material. When lever 13 is in a neutral position (as shown in the drawings) valve 12 will cause atmospheric pressure to be supplied to both branch conduits 9 and 10 so that the piston 5 within the cylinder 4 will remain in the last achieved position.

Axial movement of the sheet material 1 either to the right or to the left (as viewed in the Figure, in the directions indicated by arrow C), will reposition the roll with respect to the punch so that a series of perforated holes $a_1$, $b_1$, $c_1$, etc. can be provided axially along the roll. Further, the roll may be rotated in the directions of arrow D so as to provide circumferentially positioned apertures $c_2$, $c_3$, etc. at any desired position on the roll. In this manner, by manual or other means for repositioning of the roll, the desired number and placement of perforation holes can be provided in the sheet material so that when the sheet material is unrolled for installation the desired perforations will provide means of escape of trapped vapor or air from underneath the sheet material.

A plate 14 having an opening 15 may be used to immobilize the roll of sheet material during the punching process. Additional external forces F may be applied to the plate 14 for maintaining the roll in the desired position. Force F may be applied by pneumatic means and may be coupled to valve 12 so that upon retraction of the punch rod 6 from the roll, force F will be removed from the plate for release of the roll. Alternatively, force F may be applied independently so as to maintain pressure on the roll during removal of the punch rod from the roll.

Figure 2:
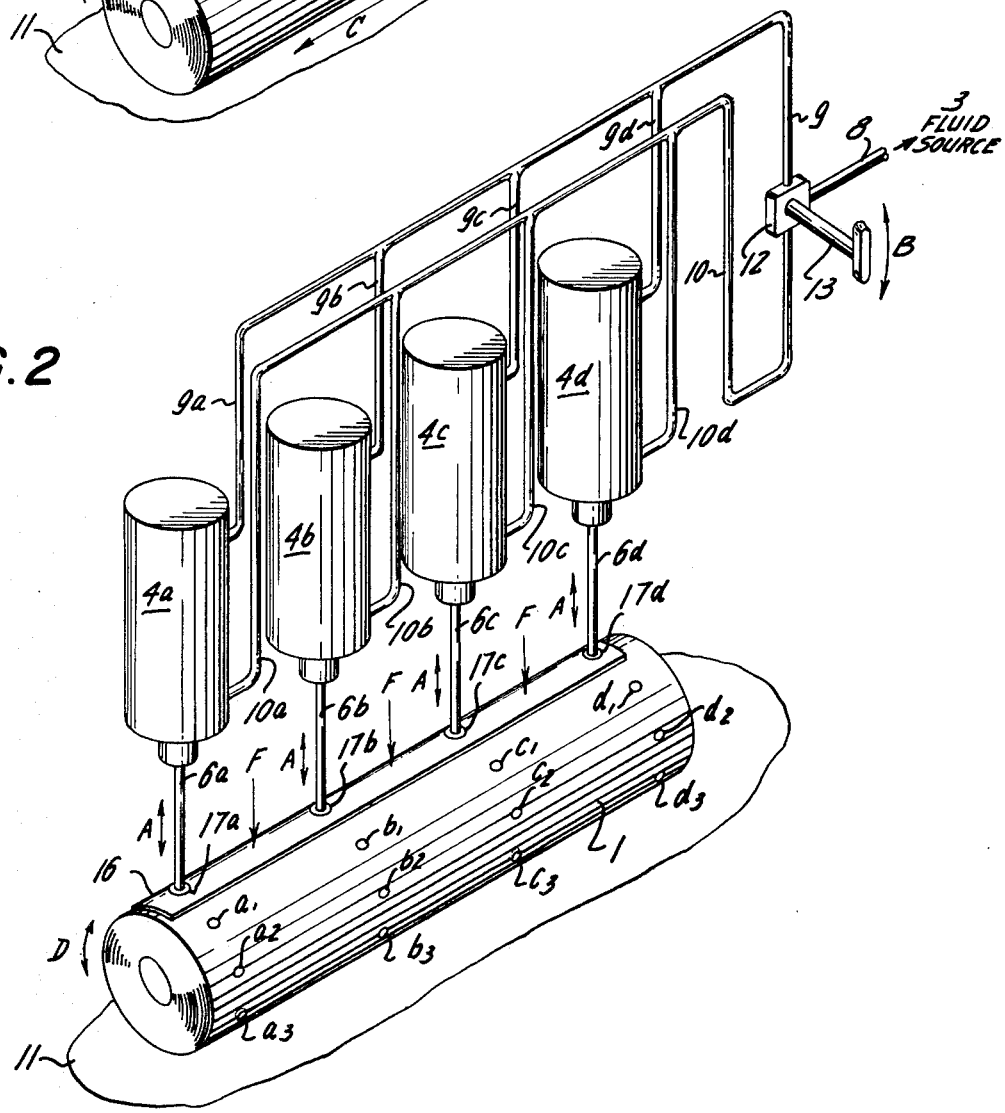
FIG. 2 is a view similar to that of FIG. 1 showing a plurality of hole punching devices used to simultaneously operate on different positions of the rolled sheet material.

FIG. 2 shows an embodiment of the present invention in which a series of pneumatic cylinders 4*a*, 4*b*, 4*c* and 4*d* are arranged in tandem so that rows *a*, *b*, *c* and *d* of perforated holes may be provided in the roll 1 of sheet material. As in the embodiment shown in FIG. 1, the roll 1 may be supported on a platform 11 and held securely in lace by a plate 16 with forces F applied thereto. The force F may be supplied by appropriate mechanical clamping means or by pressure from separate pneumatic means. Separate pneumatic means may however be connected to the main source of fluid supply, so that forces applied to the plate will be synchronized with application of pressure to the piston of the various cylinders. As previously noted, this plate may be maintained in position to immobilize the roll during removal of the rods.

Each of the cylinders is provided with a punch rod *6a, 6b, 6c,* and *6d* respectively for insertion into the roll of sheet material upon actuation of the pistons within the respective cylinders. Each of the push rods are actuated simultaneously by positioning lever 13 of valve 12 into the appropriate direction (arrow B) so the pneumatic pressure is applied to one side of the piston within the cylinder in order to drive the push rod downward. Upon completion of the downward stroke, the lever 13 is moved to the opposite position of valve 12 so as to vent the top side of the cylinder and apply pressure through branch conduit 10 to the individual conduits 10*a,* 10*b,* 10*c* and 10*d* so as to retract the push rods of each cylinder from the roll.

In this manner the rows of perforation holes can be rapidly and simultaneously applied to the roll of sheet material simply by rotating the roll in the direction of arrow D to the position desired.

The arrangement shown in FIG. 2 provides means for rapid perforation of desired holes in rolled sheet material subsequent to any manufacturing process, completely independent therefrom and in a relatively inexpensive and portable manner.

Figure 3:
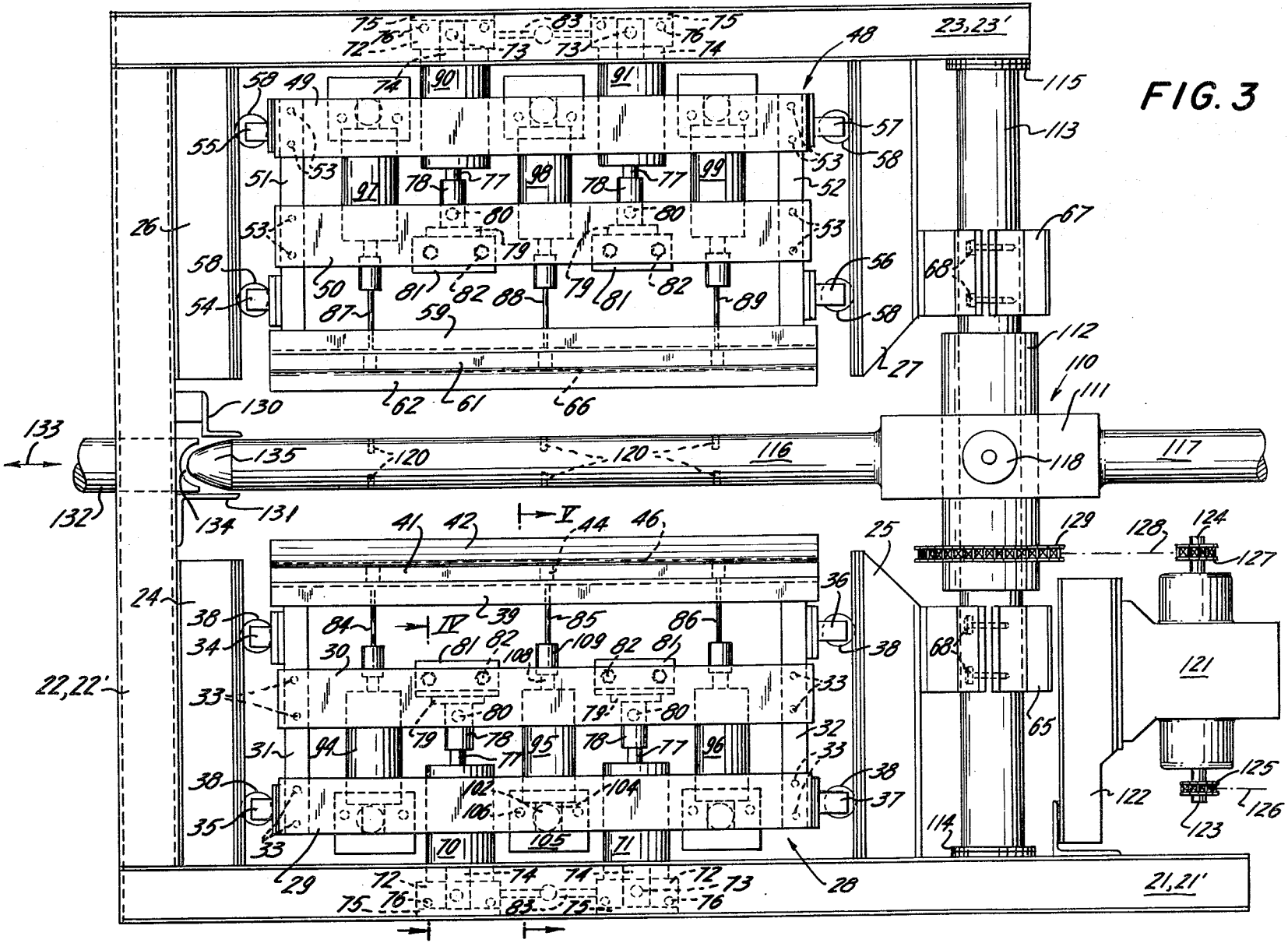
FIG. 3 is a side elevational view of an apparatus for simultaneously forming a series of perforations in a roll of sheet material supported on a spindle of a turret mechanism arranged for indexing between loading, punching and removal stations.
Figure 5:
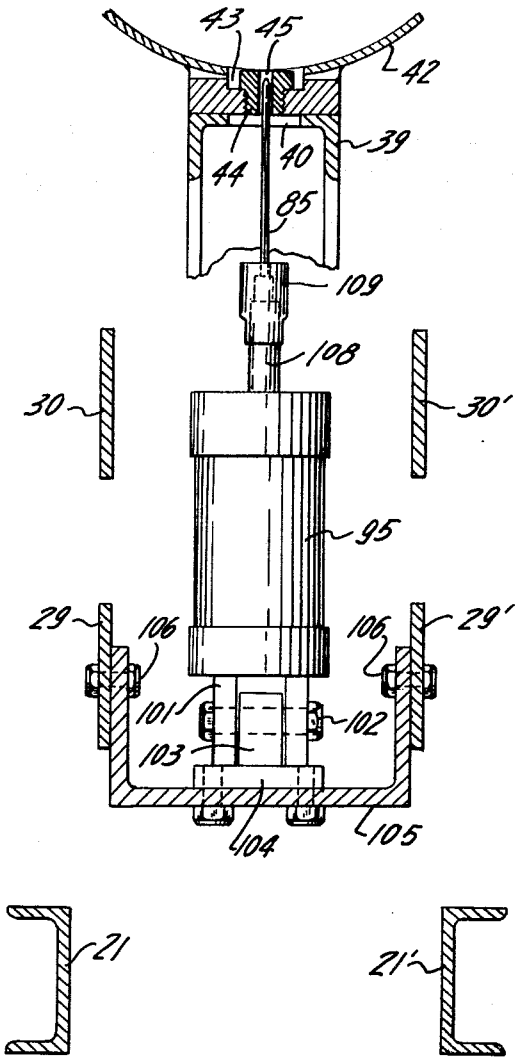
FIG. 5 is a sectional view taken along lines V — V of FIG. 3.
Figure 4:
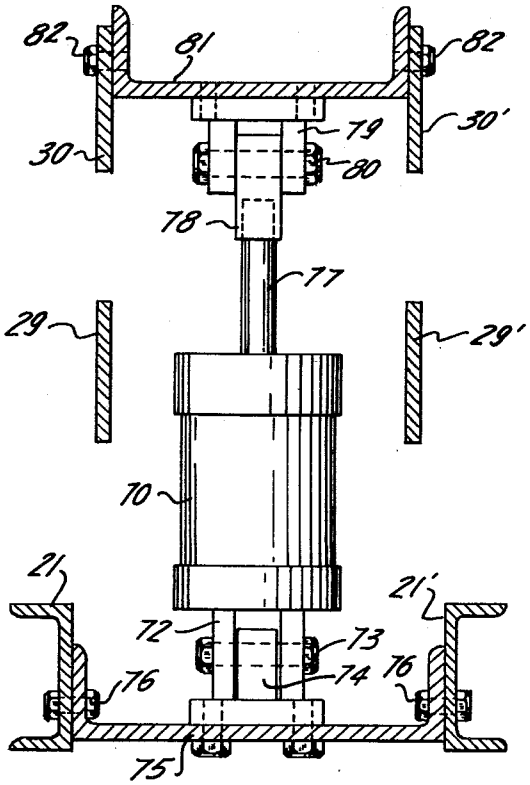
FIG. 4 is a cross-sectional view taken along the lines IV — IV of FIG. 3.

FIGS. 3, 4 and 5 show a practical embodiment of the present invention. This embodiment provides for a substantially C-shaped frame including a pair of lower beams 21, 21', arranged in side-by-side parallel relationship secured together by braces therebetween, (such as brace 75 between beams 21, 21' — see FIG. 4) a pair of upper beams 23, 23' and a pair of upstanding beams 22, 22'. Beams 23, 23' and 22, 22' are arranged in a manner similar to beams 21, 21'. Beams 22, 22' are connected between beams 21, 21' and 23, 23' at one end of each of the upper and lower beams (to the left as shown in FIG. 3). Upper and lower beams 21, 21'; 23, 23' are arranged parallel to each other and at right angles to the upstanding beams 22, 22'.

A pair of lower rails 24 and 25 are supported from the lower beams 21, 21' located substantially between beam 21 and beam 21' and carried thereon as by a brace bolted, welded or otherwise secured between the lower beams. Similarly, a pair of rails 26, 27 are supported from the upper beams 23, 23' such as by bolting, welding or otherwise securing to a brace carried between the upper beams. The lower rails 24, 25 and the upper rails 26, 27 extend in a direction substantially perpendicular to the upper and lower beams respectively. Rails 24 and 26 may be further supported between the upstanding beams 22 and 22' while rails 25 and 27 may also be additionally supported in a manner to be described more fully hereinafter.

A lower moveable frame referred to generally as numeral 28 and an upper moveable frame referred to generally as reference numeral 48 are carried between the lower rails 24, 25 and the upper rails 26, 27 respectively. The lower and upper frames 28 and 48 are arranged for movement in a direction perpendicular to the lower and upper beams in a manner to be described more fully.

Lower frame 28 generally comprises a pair of first cross members 29, 29', and a pair of second cross members 30, 30'. The cross members 29, 29' and 30, 30' are supported on columns 31 and 32, with cross members 29 and 30 visible in FIG. 3, members 29' and 30' being supported on the other side of columns 31 and 32 not visible in FIG. 3. The cross members may be secured on the columns by welding or other suitable means such as by bolts at 33 thus forming a rigid frame comprising the two sets of cross members and the columns. Column 31 is provided with brackets 34 and 35, while column 32 is provided with brackets 36 and 37. Each of the brackets 34, 35, 36 and 37 carries a wheel 39 rotatably mounted thereon for riding engagement upon the rails 24 and 25. A top cross member 39 is carried between the columns 31 and 32. The cross member 39 is provided with a slotted opening 40, for reasons to be discussed more fully hereinafter, and a guide block 41 is secured to the top cross member 39 such as by welding. A curved plate 42 is supported on the guide block 41 such as by welding or other suitable means and extends the entire length of the top cross member 39 for performing a function similar to that described with respect to plates 14 and 16 shown in the embodiments of FIGS. 1 and 2 respectively.

In a similar manner, upper frame 48 generally comprises cross members 49, 49' and 50, 50' similarly secured to columns 51 and 52 as by bolts 53. Brackets 54, 55, 56 and 57 support wheels 58 so that the upper frame 48 can ride along upper rails 26 and 27.

Also, as with lower frame 28, the upper frame is provided with a top cross member 59 having a slot 60, a guide block 61 and a curved plate 62.

The roll of sheet material to be perforated will be positioned by the apparatus to be described more fully hereinafter between lower curved plate 42 and upper curved plate 62 and will be respectively engaged by plates 42, 62 to be securely held in position during the hole punching operation.

Pneumatic cylinders 70 and 71 are employed for causing movement of lower frame 28 into a position in which plate 42 will engage the roll of sheet material, while cylinders 90 and 91 are similarly employed to operate upper frame 48 so that it is moved in a manner such that plate 62 will also engage the roll to be operated upon.

Cylinders 70 and 71 at one end thereof are secured between lower beams 21, 21' while one end of cylinders 90 and 91 are secured between upper beams 23, 23'. Each of the cylinders 70, 71, 90 and 91 carries a bifurcated extension 72 which is secured by bolts 73 to an upstanding flange 74 carried on a cross-brace 75 which is securely bolted between lower beams 21 and 21' as by bolts 76. Each of the cylinders 70, 71, 90 and 91 is provided with a piston 77 which carries an extension 78 which is coupled to a bifurcated frame 79 by bolts 80. The bifurcated frame 79 supported on cross-brace 81 by welding, bolting or other suitable fastening means. Cross brace 81 associated with cylinders 70 and 71 is secured to cross members 30 and 30' of the lower moveable frame 28 by bolts 82, while cross brace 81 associated with cylinders 90 and 91 is secured by bolts 82 to cross members 50 and 50' of upper frame 48. In this manner upper and lower frames 28 and 48 are supported for movement on rails 24, 25, and 26, 27 respectively by coupling to the cross braces 81 connected to the pistons of the respective cylinders 70, 71 and 90, 91. Accordingly, when pistons 70 and 71 are actuated their pistons 77 will be extended causing lower frame 28 to move in an upward direction as shown in FIG. 3. Similarly, when cylinders 90 and 91 are actuated their respective pistons 77 will be extended causing upper frame 48 to move in a downward direction. Pneumatic operating fluid is supplied to the cylinder 70 and 71, 90 and 91 through appropriate conduit means 83 which may be connected to a source of pressurized fluid. The cylinders 70, 71, 90 and 91 may be operated simultaneously so that curved plates 42 and 62 will be advanced toward each other at the same time for securely positioning a roll of sheet material therebetween during the punching operation.

The punching operation is accomplished by a plurality of punch rods actuated in a manner similar to that described with reference to FIGS. 1 or 2. In the present embodiment a plurality of punch rods are located both above and below the roll of sheet material to be punched so that a more uniform spacing of perforation holes can be provided in the sheet material. Further, such an arrangement eliminates the need for rotating the roll or other repositioning of the roll in order to provide a sufficient number of perforations.

The hole punching operation for perforating the roll of sheet material from below is accomplished by punch rods 84, 85 and 86 which are actuated by pneumatic cylinders 94, 95 96 respectively supported on the lower moveable frame 28. The punching operation from above the roll is accomplished by punch rods 87, 88, 89 actuated by pneumatic cylinders 97, 98, 99 respectively carried on upper moveable frame 48.

After the upper and lower frames have been moved into clamping position with respect to a roll of sheet material to be punched, the respective punch rods for the upper and lower frames will be actuated and driven through to the center of the roll for completely perforating each convoluted layer of sheet material.

For this purpose, pressure switches or micro switches may be carried on the curved plates to detect proper contact with the roll so as to actuate switch means for energizing the pneumatic punching cylinders. This may be accomplished by appropriate switches in the conduits connected to each of the punching cylinders for supplying actuating fluid thereto such as shown in FIGS. 1 and 2.

Each of the pneumatic punch cylinders 94, 95, 96 are supported on the lower frame 28 between cross members 29, 29', and similarly each of the pneumatic cylinders 97, 98, 99 are supported on the upper moveable frame 48 between cross members 49, 49'. Also, each of the punch rods 84, 85, 86 is supported and guided through guide block 41, while each of the punch rods 87, 88, 89 is supported and guided through guide block 61. The manner of supporting the punch cylinders on their respective cross frames, and the manner of supporting the punch rods in the guide blocks will be described in greater detail in connection with FIG. 5 which shows a view of pneumatic cylinder 95. It will be understood that each of the other cylinders is supported in an identical manner. Accordingly, reference numerals are omitted in FIG. 3 to the identical elements as described with respect to cylinder 95 for purposes of clarity and to avoid confusion in the figure.

Cylinder 95 carries a bifurcated frame extension 101 which is secured as by bolts 102 to an upstanding flange 103 of a frame member 104 which is secured to a cross brace 105 either by bolting or by welding. The cross brace 105 is secured between cross members 29, 29' of the lower frame 28 by bolts 106 so that the cylinder 95 is securely supported between the cross members of the frame.

Cylinder 95 carries a piston 108 with a coupling 109 for supporting the punch rod 85. The top cross member 39 is provided with a slotted opening 40 to allow passage of the punch rod 85 therethrough when the cylinder 95 is actuated. Guide block 41, carried on the top cross member 39, (and similarly guide block 61 carried on cross member 59 of the upper frame 48) is provided with threaded openings 43 for receiving a threaded guide sleeve 44 having a central bore 45 through which punch rod 85 is guided during the punching operation. The guide sleeve 44 is removeable from the opening 43 in the guide block so that one having a different sized bore may be inserted in its place to accommodate and guide a punch rod having a different diameter when perforation holes of a different size are desired to be made in the sheet material. The curved plate 42 of the lower frame 28 is also provided with a slot 46 to allow passage of the various punch rods therethrough. Similarly, curved plate 62 is provided with a slot 66.

The rolls of sheet material to be punched are carried and supported for movement to the punching station on one of a plurality of spindle arms carried for indexing movement on a turret assembly referred to generally as numeral 110. The assembly generally comprises a hub 111 carried on a collar 112 which is secured to a main column 113. The column 113 is secured by base plates 114 and 115 between the lower beams 21, 21' and the upper beams 23, 23' respectively. The base plates 114 and 115 are preferably secured between the upper and lower beams by welding so that the C-shaped frame formed by beams 21, 21'; 22, 22'; and 23, 23' is rendered rigid and undesirable bending moments are avoided.

Hub 111 of the turret is provided with a plurality of spindle arms, three of which are shown in FIG. 3, 116, 117, and 118. The hub 111 may be formed so as to accommodate any convenient number of spindle arms such as 4, 6 or 8 depending upon the speed of operation of the apparatus and the various operating stations desired. For example, when the turret is in the position shown in FIG. 3, loading of a roll of sheet material may be taking place on spindle arm 117 while the spindle arm 116 is in the punching position between the upper and lower frames 28 and 48.

The various spindles are provided with a plurality of partial bores 120 for receiving the ends of the various punch rods after they have extended through the center of the roll of sheet material.

Lower rail 25 and upper rail 27 may be additionally supported by split collars 65 and 67 respectively about the main column 113. One-half of the collars 65 and 67 may be secured to the rails by welding or other appropriate fastening means, and the two halves of the collars may be secured together such as by bolting with bolts 68.

Indexing of the turret 110 to bring the various spindle arms carrying the rolls of sheet material for perforation into the punching position is accomplished through operation of a brake-clutch 121. The brake-clutch 121 is supported on a frame 122 which is carried between the lower beams 21, 21'. The input shaft 123 of the brake-clutch 121 is driven by a sprocket wheel 125 carried thereon which is driven by a chain 126 operated by a remote driving motor.

Output shaft 124 carries a sprocket wheel 127 and collar 112 carries a sprocket wheel 129. Drive chain 128 is carried between sprocket wheels 127 and 129 for rotatably driving the collar about the column 113 for rotatably indexing turret 110 when the brake-clutch 121 is operated through the remote drive motor.

Appropriate automatic control means may be used for timing the positioning and indexing of the turret so that when a spindle arm of the turret is moved to the punching position between frames 28 and 48, appropriate switch means will be operated for providing pressurized fluid through conduits 83 to that cylinders 70 and 71 and cylinders 90, 91 will be simultaneously actuated to move lower frame 28 and upper frame 48 toward each other so that curved plates 42 and 62 respectively will engage the outer peripheral surface of a roll of sheet material supported on spindle arm 116 so as to immobilize such roll for receiving the punch rods. Appropriate pressure sensitive switch means, or other timing devices will also be utilized to actuate the respective punch rod pneumatic cylinders carried on the lower and upper frames respectively so that the punch rods will be operated to penetrate the roll thus producing the various perforations.

A source of pressurized actuating fluid is simultaneously provided to the punching cylinders 94, 95, 96 and 97, 98, 99 in a manner similar to that described with reference to the embodiment shown in FIG. 2 but not further described in FIG. 3. Accordingly, after the punching operation has taken place the punch rods will be withdrawn from the roll of sheet material by eigher manually switching the valve in the pressure fluid line such as shown in FIGS. 1 and 2 or by appropriate timed switching means. After removal of the punch rods upper and lower frames 28 and 48 will be moved apart by appropriate valve switching means in the conduits 83 so that cylinders 70, 71 and 90, 91 will cause its pistons 77 to be withdrawn. In this manner a complete punching operation is accomplished and appropriate control means will cause indexing of the turret 110 so that the roll which has been punched will be indexed to a removal station while a spindle arm, such as arm 118 carrying the next roll will be moved into the punching position.

In order to insure that the spindle arm carrying the roll to be perforated is securely positioned in the punching station an arm holding frame comprising upper bracket 130 and lower bracket 131 may be carried on the vertically positioned beams 22, 22'. Additionally, appropriate locking means 132, supported for axial movement between beams 22, 22' may be operated in the direction of arrow 133 so that a socket portion 134 will engage a locking element 135 carried on the ends of the various spindle arms. The arrangement shown herein is only representative of the various types of locking arrangements which may be provided and other means for securely positioning the spindle arm in the punching station may be provided.

The foregoing description of the practical embodiment shown in FIGS. 3, 4 and 5 provides a very efficient and preferred apparatus for performing the hole punching operations described with reference to FIGS. 1 and 2. Because punching cylinders are arranged both above and below the roll to be punched, further repositioning or placement of the roll either axially or rotatably is not necessary and successive punching operations on other rolls of sheet material can be rapidly carried out by appropriate indexing of the turret arrangement.

It should be appreciated from the foregoing that the present invention provides a method and means for perforating sheet material which overcomes the disadvantages of the prior art in that the perforated holes should not subsequently close up since no further rolling or manufacturing processes will take place so that no further forces are applied to the roll causing the holes to close. Further, the present invention provides desirable means for applying such perforation holes in the sheet material remote from any manufacturing process and independent thereof.

While the invention has been described and illustrated with respect to a certain preferred embodiment which gives satisfactory results, it will be understood by those skilled in the art, after understanding the purpose of the invention, that various other changes and modifications may be made without departing from the spirit and scope of the invention.

What is claimed is:

1. A method of forming perforation holes in sheet material comprising the steps of winding said sheet material into a roll, transporting said roll to a hole punching station, securely positioning said roll of sheet material at said hole punching station by applying a force thereto, simultaneously driving a plurality of punch rods axially spaced along said roll radially through said rolled sheet material simultaneously forming a plurality of apertures in successive wound layers of said sheet material permitting unrolling of said roll of sheet material so that said apertures will be positioned in rows and columns of the unwound sheet, and withdrawing said punch rods from said roll of sheet material substantially avoiding engagement with and tearing surrounding edges of said apertures.

2. The method according to claim 1 wherein said step of transporting said roll to a hole punching station includes the step of indexing said roll from a loading station to said hole punching station.

3. The method according to claim 2 further comprising the step of radially moving a pair of roll supporting plates from opposite directions into peripheral contact with said roll when said roll is positioned at said hole punching station for securely positioning said roll at said hole punching station.

4. The method according to claim 1 comprising the additional step of rotating said roll of sheet material after said punch rods have been withdrawn therefrom, and driving said plurality of punch rods simultaneously radially into said roll of sheet material to form a second series of apertures in successively wound layers of said sheet material.

5. The method according to claim 1 further comprising the additional step of axially repositioning said roll of sheet material after said plurality of punch rods have been withdrawn therefrom, and driving said plurality of punch rods simultaneously radially into said roll of sheet material to form a second series of apertures in successively wound layers of said sheet material.

* * * * *